US008333614B2

(12) United States Patent
Xiong et al.

(10) Patent No.: US 8,333,614 B2
(45) Date of Patent: Dec. 18, 2012

(54) ELECTRICAL CONNECTOR HAVING TERMINALS WITH INCREASED DISTANCES AMONG MOUNTING PORTIONS THEREOF

(75) Inventors: Feng Xiong, Kunshan (CN); Hong-Qiang Han, Kunshan (CN); Lun-Song Hu, Kunshan (CN); Zi-Qiang Zhu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 494 days.

(21) Appl. No.: 12/616,153

(22) Filed: Nov. 11, 2009

(65) Prior Publication Data

US 2010/0124851 A1 May 20, 2010

(30) Foreign Application Priority Data

Nov. 14, 2008 (CN) ..... 2008 2 0302788 U

(51) Int. Cl.
*H01R 24/00* (2011.01)

(52) U.S. Cl. ..... 439/660

(58) Field of Classification Search ..... None
See application file for complete search history.

(56) References Cited

U.S. PATENT DOCUMENTS 7,563,140 B1 * 7/2009 Wan et al. ..... 439/660
7,695,318 B1 * 4/2010 Wang et al. ..... 439/607.01
7,699,663 B1 * 4/2010 Little et al. ..... 439/660
7,841,905 B2 * 11/2010 Zheng et al. ..... 439/660
7,862,378 B1 * 1/2011 Wan et al. ..... 439/607.35
7,942,704 B2 * 5/2011 Ko et al. ..... 439/660
7,972,151 B2 * 7/2011 He et al. ..... 439/108
2005/0255750 A1 11/2005 Yang
2009/0130873 A1 5/2009 He
2012/0034820 A1 * 2/2012 Lang et al. ..... 439/660

* cited by examiner

*Primary Examiner* — Michael Zarroli
(74) *Attorney, Agent, or Firm* — Wei Te Chung; Ming Chieh Chang

(57) ABSTRACT

An electrical connector (100) includes an insulative housing (1) defining a main body (10) and a tongue plate (11) extending from the main body, and a number of terminals (2) retained in the insulative housing and being arranged in two rows. Each terminal has a contacting portion (201) extending into the tongue plate, a retaining portion (202) retained in the main body, a bending portion (22) extending from the retaining portion, and a tail portion (23) extending from the bending portion and comprising a mounting portion (231) for being mounted on a PCB. The bending portions (22) in each one of the two rows bending oppositely to the other row from the respective retaining portions. A distance between the two rows of the mounting portions (231) is greater than a distance between the two rows of the contacting portions (201). A distance between each two adjacent mounting portions (231) in each row is greater than a distance between the two respective contacting portions (201).

19 Claims, 9 Drawing Sheets

ELECTRICAL CONNECTOR HAVING TERMINALS WITH INCREASED DISTANCES AMONG MOUNTING PORTIONS THEREOF

BACKGROUND OF THE INVENTION

1. Field of the Invention

The present invention generally relates to an electrical connector for being mounted on a Printed Circuit Board (PCB) and more particularly to an electrical connector with improved terminals arrangement.

2. Description of Related Art

A conventional electrical connector for being mounted on a PCB usually comprises an insulative housing, a plurality of terminals retained therein, and a shell shielding the insulative housing. The terminals are arranged in two rows and comprise contacting portions, retaining portions extending from the contacting portions and retained in the insulative housing, and mounting portions extending from the retaining portions for being mounted on the PCB.

However, A distance between the two rows of the mounting portions and a distance between each two adjacent mounting portions in each row of the mounting portions are very short, and with the increased number of the terminals, the distance between each two adjacent mounting portions in each row will be much shorter. There will have few place for the soldering tin solder the mounting portions on the PCB, and a solder bridge will occur and join the mounting portions together to form a short circuit easily.

Hence, an improvement over the prior art is required to overcome the problems thereof.

SUMMARY OF THE INVENTION

According to one aspect of the present invention, an electrical connector comprises an insulative housing defining a main body and a tongue plate extending from the main body, and a plurality of terminals retained in the insulative housing and being arranged in two rows. Each terminal comprises a contacting portion extending into the tongue plate, a retaining portion retained in the main body, a bending portion extending from the retaining portion, and a tail portion extending from the bending portion and comprising a mounting portion for being mounted on a PCB. The bending portions in each one of the two rows bending oppositely to the other row from the respective retaining portions. A distance between the two rows of the mounting portions is greater than a distance between the two rows of the contacting portions. A distance between each two adjacent mounting portions in each row is greater than a distance between the two respective contacting portions.

According to another aspect of the present invention, an electrical connector for being mounted on a PCB in a vertical direction comprises an insulative housing defining a main body and a tongue plate extending upwardly from the main body, and a plurality of terminals comprising contacting portions arranged in two rows with respect to a front-to-rear direction and retained in the tongue plate, retaining portions extending from lower ends of the respective contacting portions, and mounting portions extending downwardly for being mounted on the PCB and arranged in two rows with respect to the front-to-rear direction. A distance between the two rows of the mounting portions is greater than a distance between the two rows of the contacting portions. A distance between each two adjacent mounting portions in each row is greater than a distance between the two respective contacting portions. A shell shielding the insulative housing.

These and additional objects, features, and advantages of the present invention will become apparent after reading the following detailed description of the preferred embodiment of the invention taken in conjunction with the appended drawings.

DETAILED DESCRIPTION OF THE INVENTION

Figure 1:
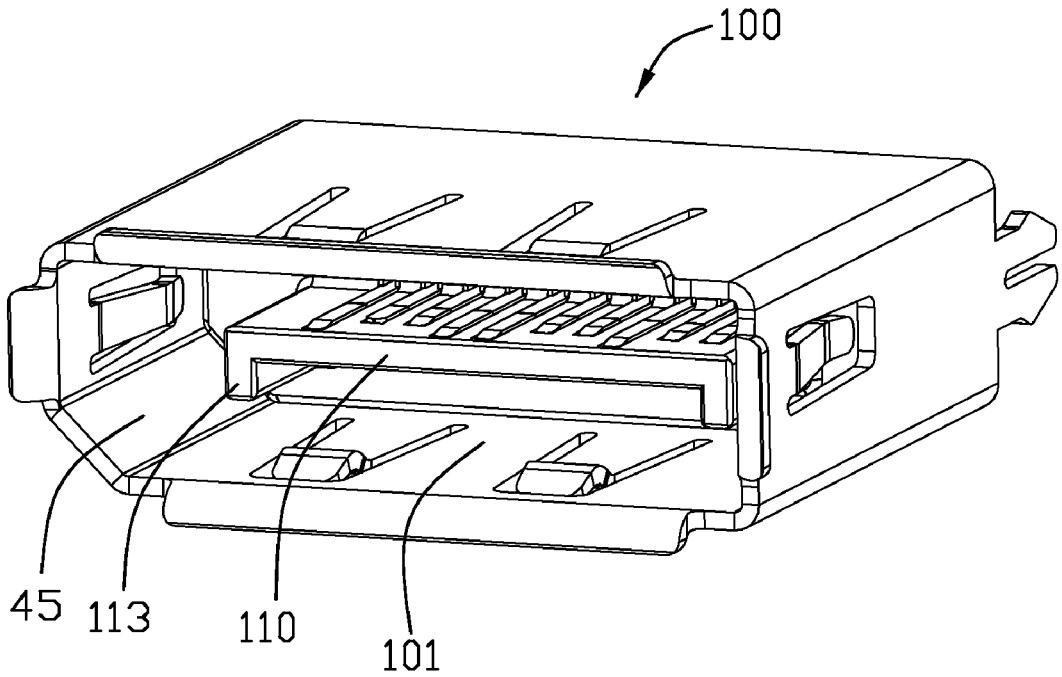
FIG. 1 is a perspective view of an electrical connector according to an embodiment of the present invention.

Reference will now be made to the drawing figures to describe the preferred embodiment of the present invention in detail.

Figure 2:
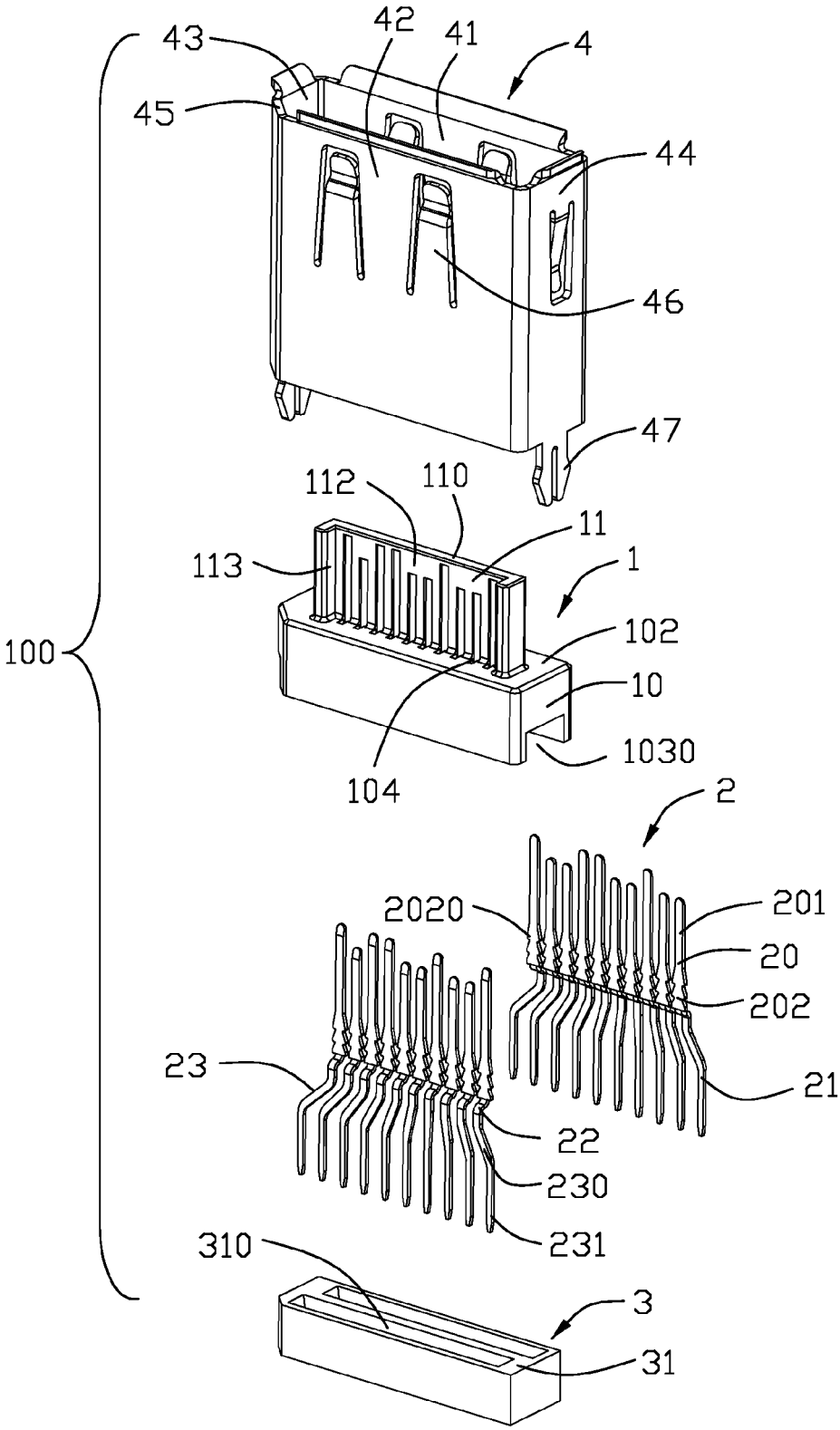
FIG. 2 is an exploded view of the electrical connector shown in FIG. 1.
Figure 3:
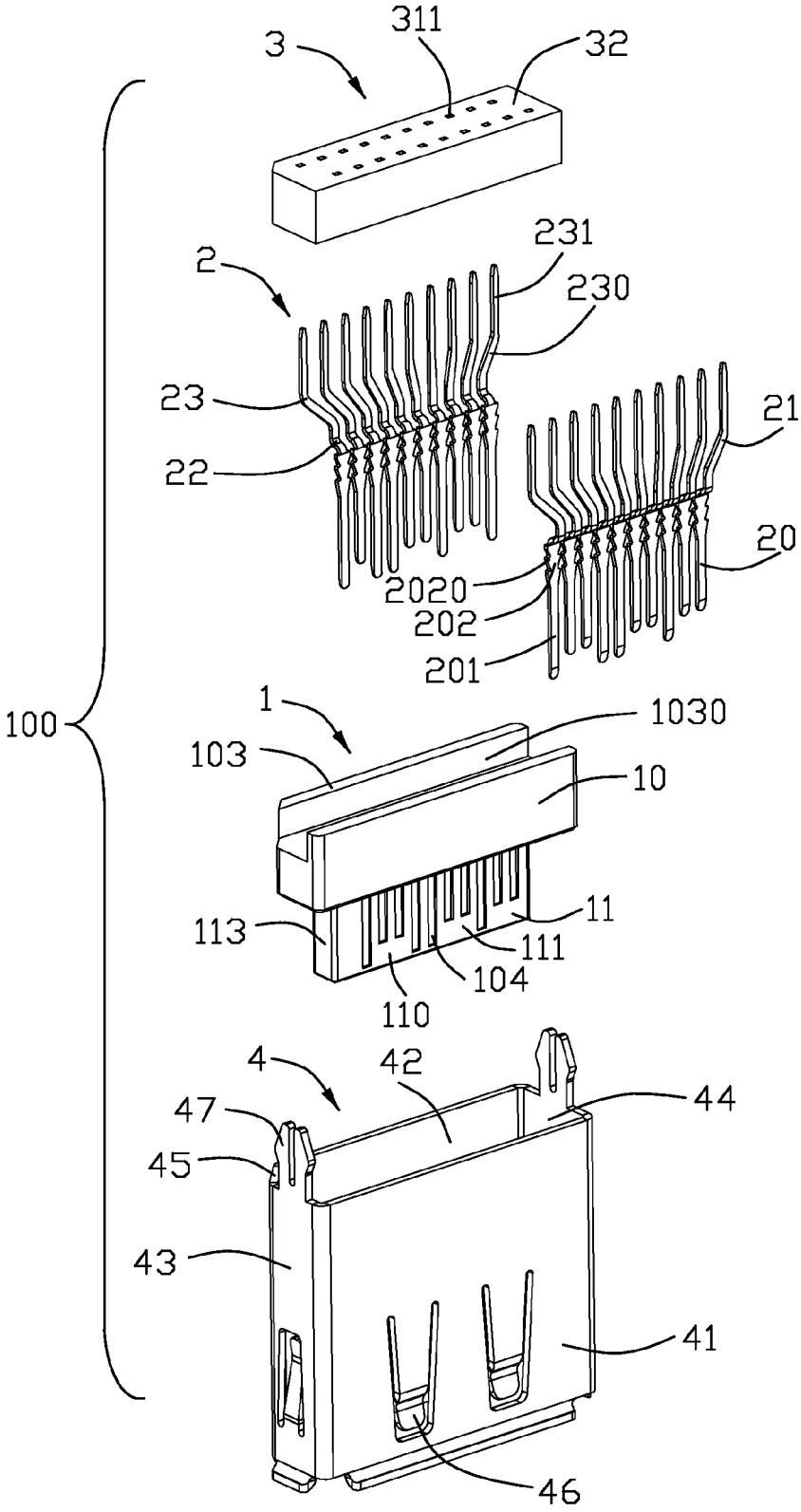
FIG. 3 is an another exploded view of the electrical connector shown in FIG. 1.

Referring to FIGS. 1-3, an electrical connector 100 according to an embodiment for being mounted on a Printed Circuit Board (PCB) in a vertical direction includes an insulative housing 1, a number of terminals 2 coupled to the insulative housing 1, a spacer 3 for retaining the terminals 2, and a shell 4 for covering the insulative housing 1 and formed a chamber 101 for receiving a plug (not shown).

Referring to FIGS. 1-2, the insulative housing 1 includes a rectangular main body 10, a tongue plate 11 extending upwardly into the chamber 101 from the main body 10. The main body 10 defines a upper surface 102, a lower surface 103 opposite to the upper surface 102, and a receiving slot 1030 recessed upwardly from the lower surface 103. the tongue plate 11 includes a vertical portion 110 extending along a vertical direction and a pair of stopping portions 113 extending forwardly from two lateral sides of the vertical portion 110. The stopping portions 113 can mating with the plug so as to prevent the plug from mismating. The vertical portion 110 defines a front face 111 and a rear face 112 opposite to the front face 111. The insulative housing 1 defines a number of passageways 104 arranged on the front and rear face 111, 112 and passing through the main body 10 in the vertical direction.

Figure 4:
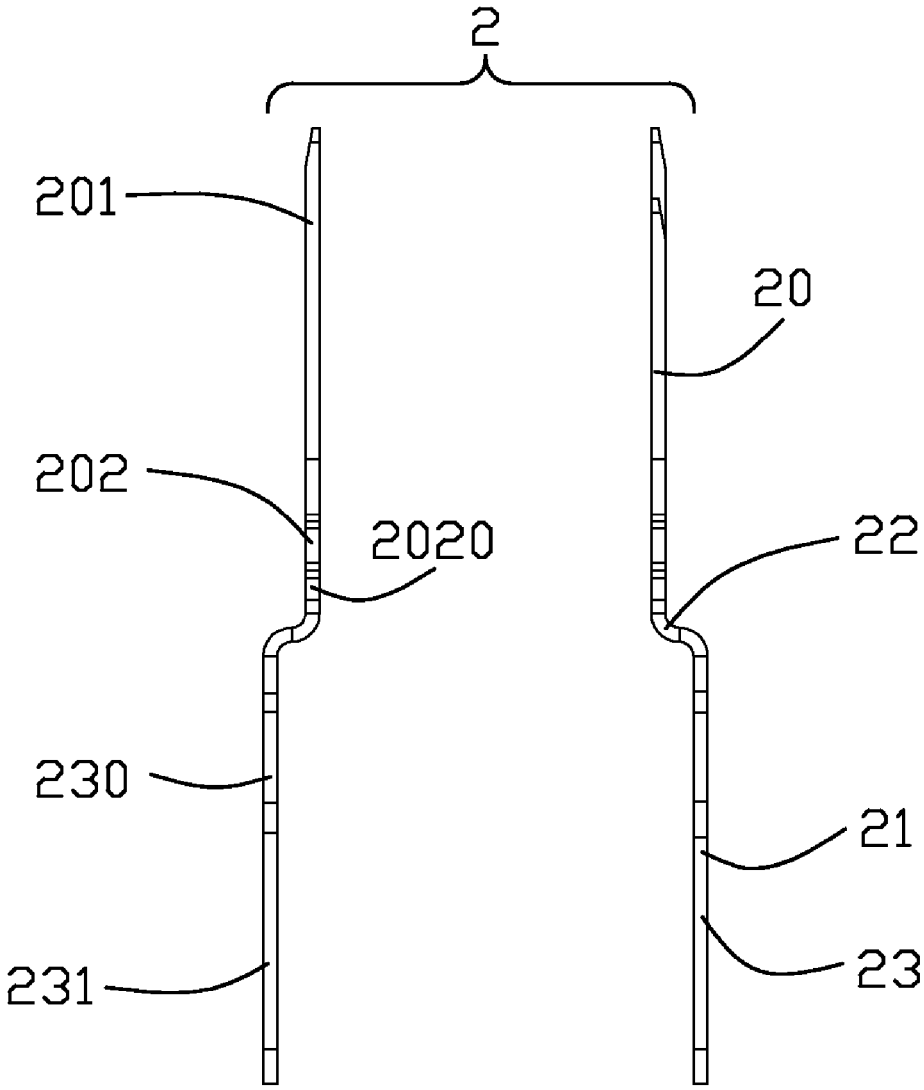
FIG. 4 is a side view of terminals of the electrical connector shown in FIG. 2.
Figure 5:
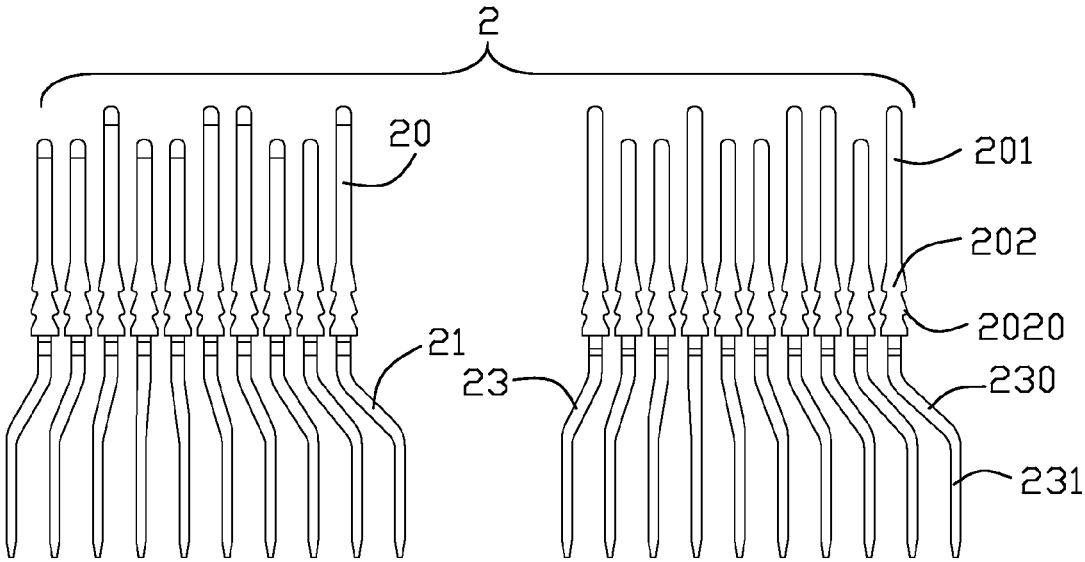
FIG. 5 is a front view of the terminals of the electrical connector shown in FIG. 2.
Figure 6:
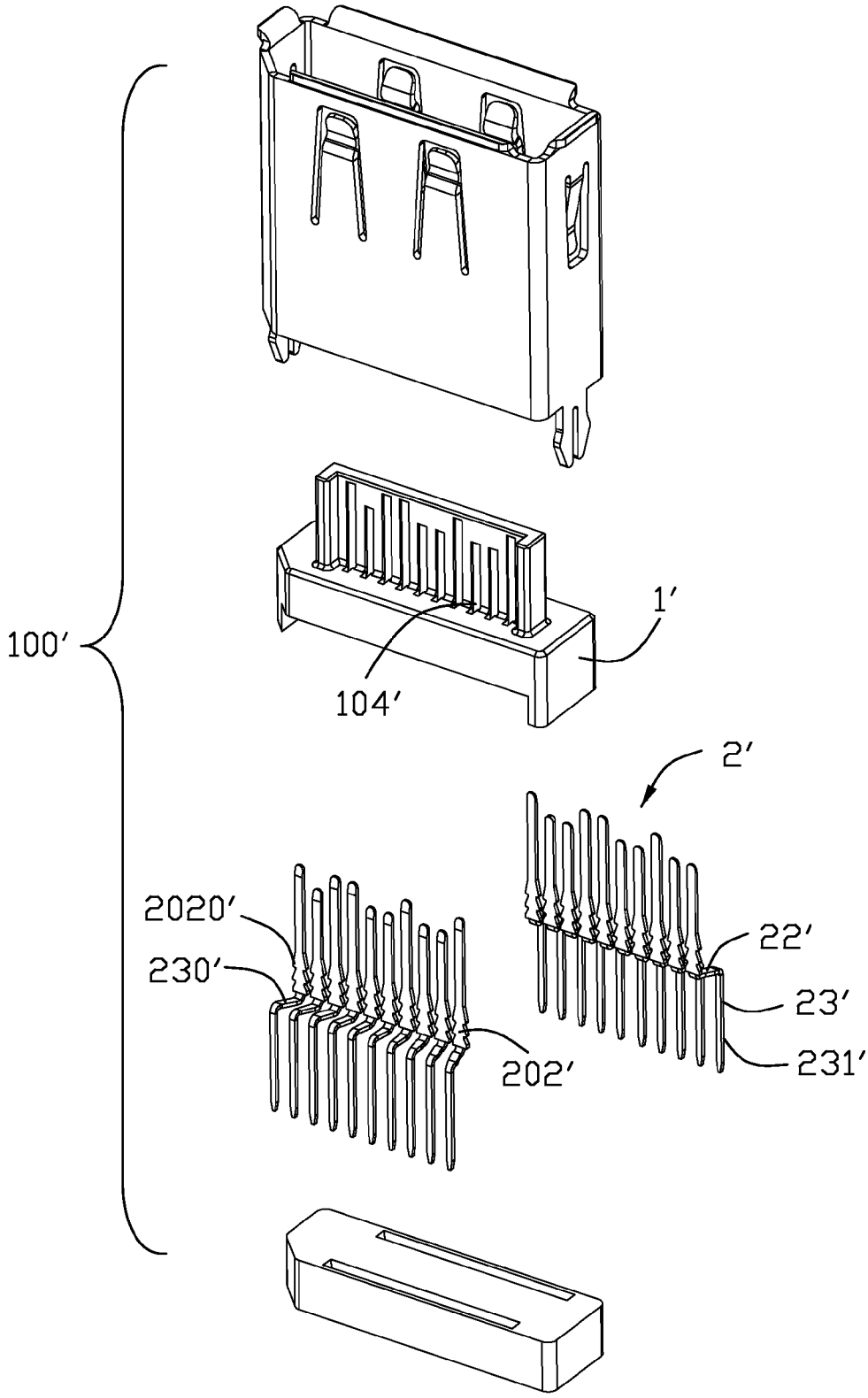
FIG. 6 is an exploded view of an electrical connector according to an another embodiment of the present invention.
Figure 7:
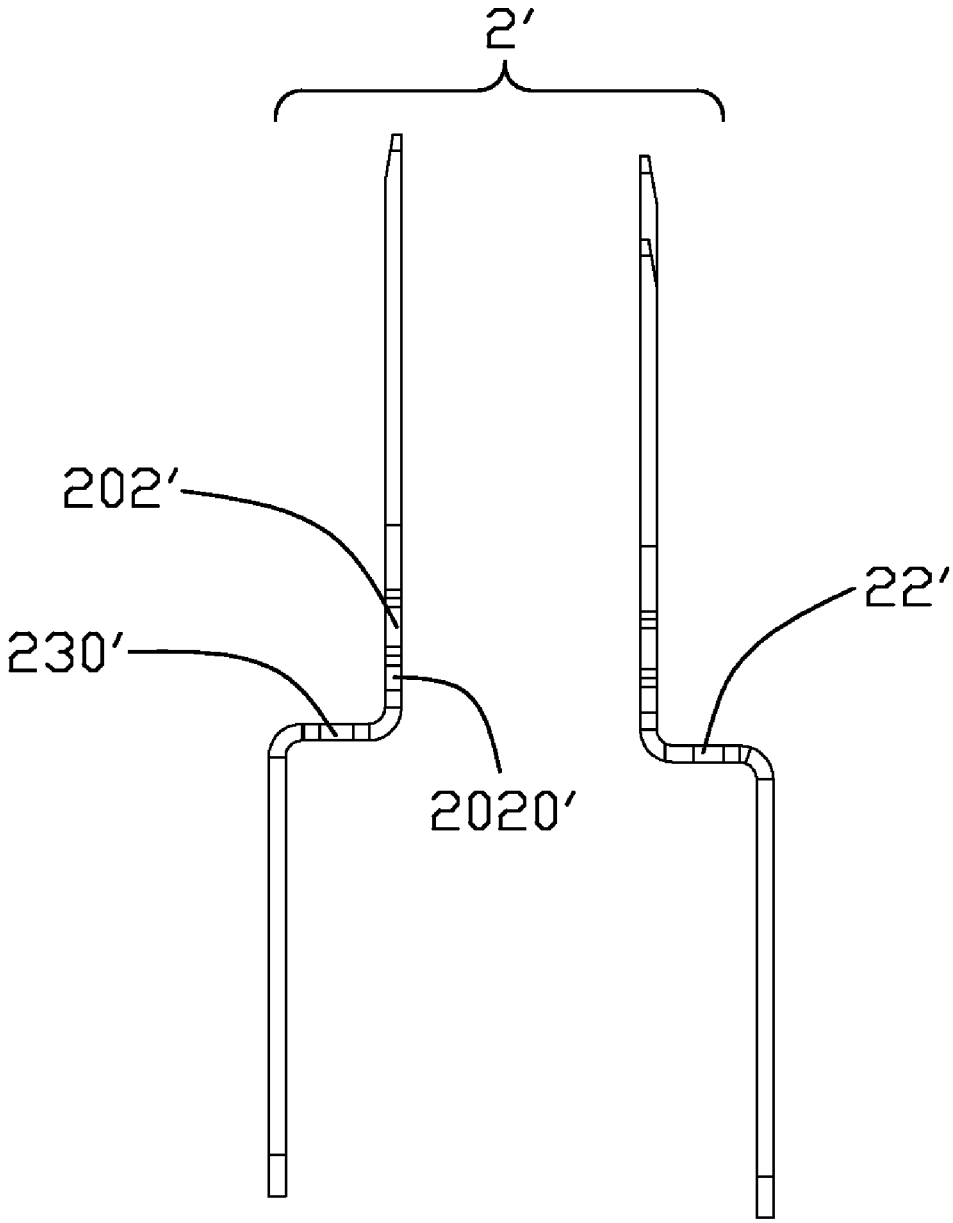
FIG. 7 is a side view of terminals of the electrical connector shown in FIG. 6.
Figure 8:
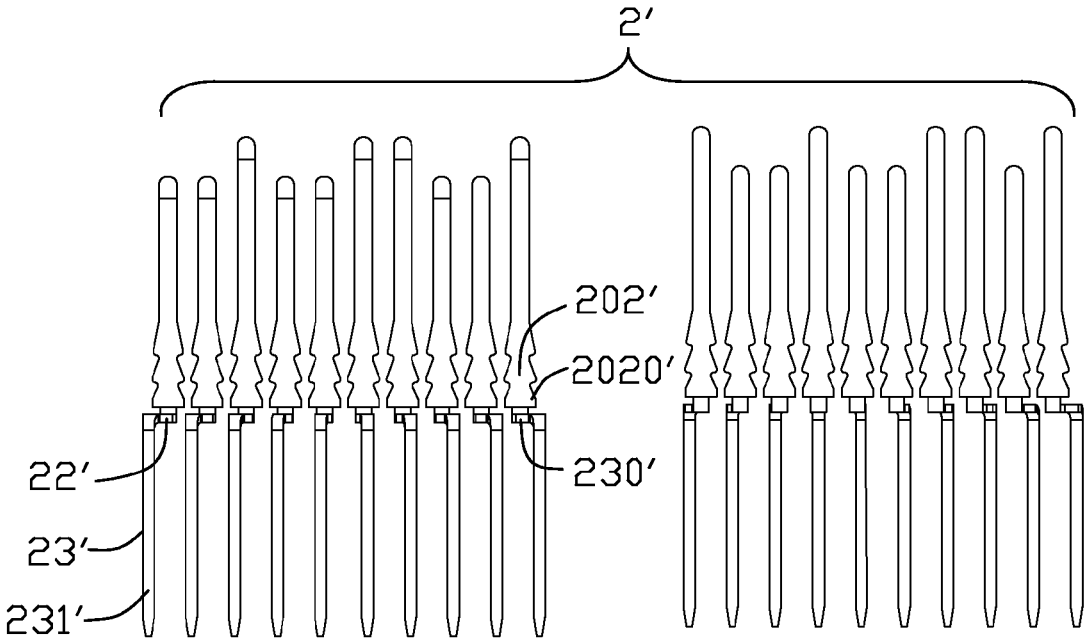
FIG. 8 is a front view of the terminals of the electrical connector shown in FIG. 6.
Figure 9:
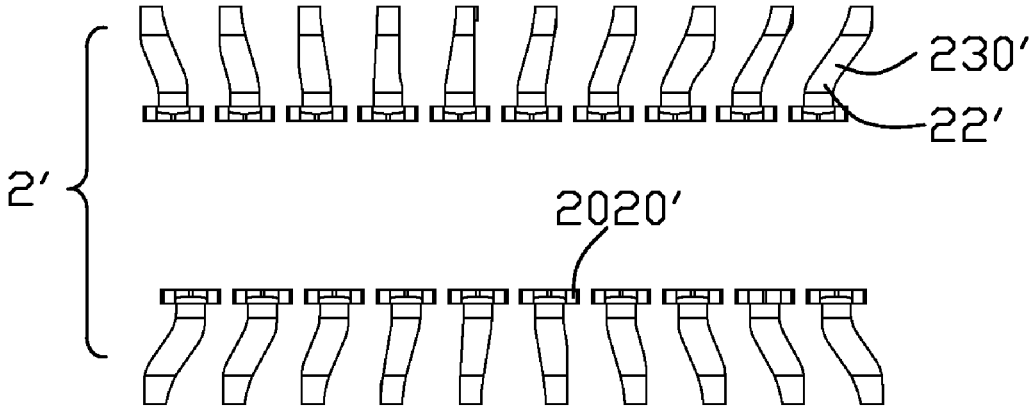
FIG. 9 is a top view of the terminals of the electrical connector shown in FIG. 6.

Referring to FIGS. 4 and 5, the terminals 2 which are received in the passageways 104 are stamped and formed of conductive sheet metal materials, and are presented as planar shape. The terminals 2 are arranged in two rows with respect to a front-to-rear direction. Each terminal 2 includes an upper portion 20 and a lower portion 21 extending downwardly from the upper portion 20. The upper portion 20 includes a contacting portion 201 received in the corresponding passageway 104 in the tongue plate 11 and exposed into the chamber 101, and a retaining portion 202 retained in the respective passageway 104 in the main body 10. The retaining portion 202 has a set of agnails 2020 protruding from two lateral sides thereof for interfering with the main body 10. Therefore, the retaining portion 202 could be retained in the passageway 104 firmly. The lower portion 21 includes a bending portion 22 extending from a lower end of the retaining portion 202 and a tail portion 23 extending downwardly from the bending portion 22. Each tail portion 23 includes an oblique portion 230 extending downwardly from the bending portion 22 and a mounting portion 231 extending downwardly from the oblique portion 230 for being mounted on the PCB. The bending portions 22 in the front row bend forwardly from the lower ends of the respective retaining portions 202, and the bending portions 22 in the rear row bend backwardly from the lower ends of the respective retaining portions 202. Because the tail portions 23 extend downwardly from the bending portions 22 and are arranged in two rows with respect to the front-to-rear direction, a distance between the two rows of the mounting portions 231 is greater than a distance between two rows in which the contacting portions 201 are arranged. In each row of the terminals 2, the oblique portions 230 are bent and extend obliquely downwardly at different angles toward two lateral sides of the insulative housing 1, and the oblique portions 230 being closer to the two lateral sides of the insulative housing 1, the bigger angle benting toward two lateral sides of the insulative housing 1. Because the mounting portions 231 extending vertically downwardly from the lower ends of the respective oblique portions 230, a distance between each two adjacent mounting portions 231 in each row of the terminals 2 is greater than a distance between the two respective contacting portions 201. Therefore, the greater distance between the two rows of the mounting portions 231 and the greater distances between the each two adjacent mounting portions 231 in each row of the terminals will offer more spaces for soldering the soldering tin onto the mounting portions 231 and the PCB more easily.

Furthermore, because the bending portions 22 in each row of the terminals 2 are coplanar in a plane and intersect a plane in which the contacting portions 201 and the retaining portions 202 are coplanar, the oblique portions 230 which extend from the bending portions 22 and the mounting portions 231 which extend vertically downwardly from the oblique portions 230 in each row are coplanar in a plane and parallel to the plane in which the contacting portions 201 and the retaining portions 202 are coplanar with respect to the front-to-rear direction, a lower end of the retaining portion 202 under the agnails 2020 will be clasped and fitted into the respective passageway 104 of the main body 10 by a tool easily.

Referring to FIGS. 2 and 3, the spacer 3 are received in the receiving slot 1030 to be retained in the insulative housing 1. The spacer 3 defines an upper surface 31 and a lower surface 32 opposite to the upper surface 31. The spacer 3 includes a pair of grooves 310 recessed from the upper surface 31 for receiving the oblique portions 230 and a number of through holes 311 for the mounting portions 231 passing through.

Referring to FIGS. 1-5, the shell 4 covers the insulative housing 1 and includes a front wall 42, a rear wall 41 opposite to the front wall 42, a pair of side walls 43, 44, and a inclined wall 45 connecting the front wall 42 and one of the side walls 43, 44. the inclined wall 45 can mate with the plug so as to prevent the plug from mismating. A number of clips 46 are formed on the front wall 42, rear wall 41, and the side walls 43, 44. Each of the side walls 43, 44 has a leg 47 extending downwardly from a lower end thereof to be retained in the PCB.

Referring to FIGS. 6-9, an electrical connector 100' according to an another embodiment of the present invention, the bending portions 22' in each row of the terminals 2' are bent and extend obliquely downwardly at different angles toward two lateral sides of the insulative housing 1' to form the oblique portions 230'. The mounting portions 231' extending vertically downwardly from the respective bending portions 22' to form the tail portions 23'. Therefore, the distance between the each two adjacent mounting portions 231' in each row of the terminals 2' can be increased too. Furthermore, the bending portions 22' in each row of the terminals 2' are coplanar in a plane and intersect a plane in which the retaining portions 202' are coplanar, the mounting portions 231' which extend vertically downwardly from the bending portions 22' in each row are coplanar in a plane and parallel to the plane in which the retaining portions 202' are coplanar with respect to the front-to-rear direction, the lower end of the retaining portion 202' under the agnails 2020' will be clasped and fitted into the respective passageway 104' by a tool easily too.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing defining a main body and a tongue plate extending from the main body; and a plurality of terminals retained in the insulative housing and being arranged in two rows, each terminal comprising a contacting portion extending into the tongue plate, a retaining portion retained in the main body, a bending portion extending from the retaining portion, and a tail portion extending from the bending portion and comprising a mounting portion for being mounted on a PCB; wherein the bending portions in each one of the two rows bending oppositely to the other row from the respective retaining portions, a distance between the two rows of the mounting portions is greater than a distance between the two rows of the contacting portions, a distance between each two adjacent mounting portions in each row is greater than a distance between the two respective contacting portions.

2. The electrical connector as claimed in claim 1, wherein each tail portion further comprises an oblique portion connecting the mounting portion and the bending portion, the oblique portion extends obliquely at an angle toward one lateral side of the insulative housing.

3. The electrical connector as claimed in claim 2, wherein the oblique portions in each row of the terminals extend obliquely at different angles toward two lateral sides of the insulative housing, and the closer to the two lateral sides of the insulative housing, the bigger angle the oblique portions bend toward two lateral sides of the insulative housing.

4. The electrical connector as claimed in claim 1, wherein the bending portion extends obliquely at an angle toward one lateral side of the insulative housing.

5. The electrical connector as claimed in claim 4, wherein the bending portions in each row of the terminals extend obliquely at different angles toward two lateral sides of the insulative housing, and the closer to the two lateral sides of the insulative housing, the bigger angle the bending portions toward two lateral sides of the insulative housing, the mounting portions extending from the respective bending portions.

6. The electrical connector as claimed in claim 1, wherein the retaining portion has a plurality of barbs protruding from two lateral sides thereof for interfering with the main body.

7. The electrical connector as claimed in claim 1, wherein the tail portions in each row of the terminals are essentially coplanar in a plane and parallel to a plane in which the respective contacting portions and the respective retaining portions are coplanar.

8. The electrical connector as claimed in claim 1, wherein the electrical connector further comprises a spacer for retaining the terminals therein and a shell for shielding the insulative housing.

9. An electrical connector for being mounted on a PCB in a vertical direction, comprising:

an insulative housing defining a main body and a tongue plate extending upwardly from the main body;

a plurality of terminals comprising contacting portions arranged in two rows with respect to a front-to-rear direction and retained in the tongue plate, retaining portions extending from lower ends of the respective contacting portions, and mounting portions extending downwardly for being mounted on the PCB and arranged in two rows with respect to the front-to-rear direction, a distance between the two rows of the mounting portions is greater than a distance between the two rows of the contacting portions, a distance between each two adjacent mounting portions in each row of the mounting portions is greater than a distance between the two respective contacting portions; and a shell shielding the insulative housing.

10. The electrical connector as claimed in claim 9, wherein the retaining portions are arranged in two rows with respect to the front-to-rear direction, the terminals comprise bending portions extending from lower ends of the respective retaining portions and arranged in two rows with respect to the front-to-rear direction, the bending portions in the front row bend forwardly from the lower ends of the respective retaining portions, the bending portions in the rear row bend backwardly from the lower ends of the respective retaining portions.

11. The electrical connector as claimed in claim 10, wherein the terminals further comprise oblique portions connecting the bending portions and the mounting portions, the oblique portions are arranged in two rows with respect to the front-to-rear direction, the oblique portions extend obliquely downwardly at angles toward two lateral sides of the insulative housing.

12. The electrical connector as claimed in claim 11, wherein each row of the oblique portions extend obliquely downwardly at different angles toward two lateral sides of the insulative housing, and the closer to the two lateral sides of the insulative housing, the bigger angle the oblique portions toward two lateral sides of the insulative housing.

13. The electrical connector as claimed in claim 11, wherein each row of the oblique portions and the mounting portions are essentially coplanar in a plane and parallel to another plane in which the respective contacting portions and the respective retaining portions are essentially coplanar.

14. The electrical connector as claimed in claim 11, wherein the electrical connector further comprises a spacer for being retained in the insulative housing, the spacer defines a pair of grooves recessed from an upper surface and located in the front-to-rear direction for receiving the two rows of the oblique portions, a plurality of through holes are disposed on the spacer and under the grooves for the mounting portions passing through.

15. The electrical connector as claimed in claim 10, wherein the bending portions in each row extend obliquely at different angles toward two lateral sides of the insulative housing, and the closer to the two lateral sides of the insulative housing, the bigger angle the bending portions toward two lateral sides of the insulative housing, the mounting portions extending vertically downwardly from the respective bending portions.

16. The electrical connector as claimed in claim 9, wherein each retaining portion has a plurality of barbs protruding from two lateral sides thereof for interfering with the main body.

17. An electrical connector comprising:

an insulative housing including a main body with a mating tongue extending upwardly therefrom in a vertical direction and defining two opposite mating faces thereon;

two rows of contacts disposed in the housing, each of said contacts including a contacting section seated upon a corresponding one of said two opposite mating faces, a retention section coplanar with the contacting section, a mounting section extending downward beyond a bottom face of the housing in said vertical direction, and a bending section linked between the contacting section and the mounting section; wherein said mounting section is horizontally offset from the contacting section in a top view, along not only a lengthwise direction, along which said mating tongue extends, but also a transverse direction, to which said mating tongue is perpendicular.

18. The electrical connector as claimed in claim 17, further including a spacer located under the bottom face, wherein said spacer defines two rows of through holes in an undersurface thereof to retain the corresponding mounting sections, respectively, and two slots extending in the lengthwise direction in an upper face thereof communicating with the corresponding through holes in the vertical direction.

19. The electrical connector as claimed in claim 17, wherein the contacting sections of the contacts in one row are commonly seated upon the corresponding one of the two opposite mating faces, and the contacting sections of the contacts in the other row are commonly seated upon the other one of the two opposite mating faces.

* * * * *